US006307168B1

(12) United States Patent
Newham

(10) Patent No.: US 6,307,168 B1
(45) Date of Patent: Oct. 23, 2001

(54) LINEAR SPACED DIELECTRIC DOT SEPARATOR PRESSURE SENSING ARRAY INCORPORATING STRAIN RELEASE STABILIZED RELEASABLE ELECTRIC SNAP STUD CONNECTORS

(76) Inventor: Paul Newham, 707 Cypresstree, San Antonio, TX (US) 78245

( * ) Notice: Subject to any disclaimer, the term of this patent is extended or adjusted under 35 U.S.C. 154(b) by 0 days.

(21) Appl. No.: 09/532,491

(22) Filed: Mar. 22, 2000

Related U.S. Application Data

(60) Provisional application No. 60/125,732, filed on Mar. 23, 1999.

(51) Int. Cl.[7] ..... H01H 3/02
(52) U.S. Cl. ..... 200/86 R
(58) Field of Search ..... 200/5 A, 5 R, 200/85 A, 85 R, 86 A, 86 R, 512–517

(56) References Cited

U.S. PATENT DOCUMENTS

| | | | | |
|---|---|---|---|---|
| 3,617,666 | * | 11/1971 | Braue | 200/86 R |
| 4,317,013 | * | 2/1982 | Larson | 200/5 A |
| 4,471,177 | * | 9/1984 | Doughty | 200/5 A |
| 4,484,043 | | 11/1984 | Musick et al. | 200/85 R |
| 4,565,910 | | 1/1986 | Musick et al. | 200/85 R |
| 4,700,025 | * | 10/1987 | Hatayama et al. | 200/5 A |
| 4,801,771 | * | 1/1989 | Mizuguchi et al. | 200/86 R |
| 4,818,827 | * | 4/1989 | Ipcinski et al. | 200/5 A |
| 4,864,084 | * | 9/1989 | Cardinale | 200/5 A |
| 5,373,128 | * | 12/1994 | Rosakranse et al. | 200/86 A |
| 5,554,835 | | 9/1996 | Newham | 200/85 R |
| 5,623,760 | | 4/1997 | Newham | 29/622 |
| 5,810,604 | * | 9/1998 | Kopp, Jr. et al. | 200/5 A |
| 6,025,782 | * | 2/2000 | Newham | 307/116 |

* cited by examiner

*Primary Examiner*—J. R. Scott
(74) *Attorney, Agent, or Firm*—Cox & Smith Incorporated

(57) ABSTRACT

A pressure sensing array has upper, central and lower laminar elongated members, the central member having several openings producing defined cavities between the upper and lower members. A first array of essentially parallel and separated electrically conductive bands are created upon the upper surface of the lower member and traverse the several cavities created by the central member. Affixed to the top surface of the aforesaid electrically conductive bands are non-conductive separator dots positioned in a defined linear spaced pattern and composed of an appropriate dielectric material. A secondary dual arrangement of substantially parallel, separated, electrically conductive bands are attached to the lower surface of the upper member, each individual electrically conductive band being discreetly connected to a strain relief stabilized releasable electric snap stud connector. The upper and lower members of the assembled array posses appropriate resilient flexibility permitting the overlapping points of the opposing conductive arrays to close into and open out of electrical contact as permitted by, and controlled with, the linear dot dielectric separators and in response to external soft body mass pressure, exerted on the overall pressure sensing array structure.

12 Claims, 3 Drawing Sheets

(SECT. A-A)

(SECT. B-B)

LINEAR SPACED DIELECTRIC DOT SEPARATOR PRESSURE SENSING ARRAY INCORPORATING STRAIN RELEASE STABILIZED RELEASABLE ELECTRIC SNAP STUD CONNECTORS

RELATION TO OTHER APPLICATION

This application claims the benefit of U.S. Provisional Patent Application Ser. No. 60/125,732, filed Mar. 23, 1999.

BACKGROUND OF THE INVENTION

1. Field of the Invention

This invention relates generally to pressure sensing switch arrays and more specifically concerns switch arrays for the detection of the presence or absence of a person from a hospital bed, wheel chair, medical seating structure, baby carriage or any other body supporting structure to which it may be useful to determine the status of occupancy, and to the method of making such switches.

2. Description of the Related Art

Pressure sensing switch arrays presently used in many medical facilities are disclosed in previously issued U.S. Pat. Nos. 4,484,043 and 4,565,910. In these known devices, broad bands of conductive material are used in upper and lower layers in such a way that contact between any portion of the upper and lower layer completes an electrical circuit. While this type of switch array works reasonably electrically, they are somewhat difficult and slow to manufacture in a manner providing consistency and predictability of operation and consequently sufficiently expensive to limit their broad use as a single use disposable device. Equivalently they have difficulty in reliably sensing patient body mass weights of less than 100 pounds. These known devices are also of relatively thick profile and stiffness to provide adequate separation of the conductive bands thereby resulting in diminished patient comfort when in use. Also, these known devices are not completely sealed and therefore do not provide a fluid impervious device, potentially compromising the devices integrity and consistency of operation.

An alternative pressure sensing switch design is disclosed in previously issued U.S. Pat. Nos. 5,554,835 and 5,623,760. The functionality of the device identified in these known patents derives from membrane switch technology comprising an upper, middle and lower laminar elongated members. Electrically conductive elements affixed to the lower surface of the upper member traverse cavities provided by the structure of the middle member. A second array of electrically conductive bands are fixed to the upper surface of the lower member and equivalently traverse the cavities provided by the middle member and the upper member bands. Selected lower member conductive bands are discretely connected to pins of an electrical input connector and the other lower member bands are discretely connected to alternative pins of the same electrical connector forming an output lead. An array of substantially parallel spaced apart dielectric bands is fixed to the lower member upper surface and traverses the cavities between the first and second arrays of conductive bands at a forty-five degree angle in such a way to separate the first and second arrays of conductive bands from making electrical contact with each other in the area of overlap between the dielectric bands.

Pressure derived electrical activation of the first described pressure sensitive switch design identified in U.S. Pat. Nos. 4,484,043 and 4,565,910 is more frequently achieved by a crimping or kinking of the device than by direct pressure application through the exterior of the upper or lower surface of the device. Pressure derived electrical switch activation of the second described device disclosed in U.S. Pat. Nos. 5,554,835 and 5,623,760 is achieved by direct pressure application to the outer surface of either the upper or lower member or by flexation of the device. It is, however, a function of the second described device that reliable pressure derived switch activation typically occurs only when direct pressure is applied to a small surface area location—typically less than one square inch—at any given location on the outer surfaces of the upper or lower members. Equivalent, or even substantially greater pressure when applied to a larger surface area—up to and including the entire surface area of the device—will not reliably result in electrical switch contact within the device unless the device exhibits considerable flex under such pressure or the applied direct pressure over a large surface area of the device exceeds one hundred pounds body mass weight or greater. Additionally, this described device exhibits complexity and expense in manufacturing and operation due to its utilization of an electronic style electrical connector to permit the inflow and output of a suitable derived external driver current to be applied to the device. The pressure sensing switch array of the present invention has specific design features which distinguish it from the prior art devices.

SUMMARY OF THE INVENTION

In accordance with the invention, a pressure sensing switch array is provided having upper, middle, and lower laminar elongated members. The middle member has one or more openings which define one or more cavities between the upper and lower members. A first array of essentially parallel, spaced apart electrically conductive bands is fixed to an upper surface of the lower member and traverses the cavities. A second array of substantially parallel spaced apart electrically conductive bands is fixed to the lower surface of the upper member and traverses the cavities and the lower member bands. Selected upper member bands are discretely connected to a strain relief stabilized releasable electrical snap stud connector and the other upper member bands are discretely connected to a second strain relief stabilized releasable electrical snap stud connector. A dielectric dot matrix of specific configuration, consistency and linear placement is affixed to the upper surface of the electrically conductive bands traversing the upper surface of the lower member in such a manner to effectively separate and control the first and second arrays of conductive bands from making electrical contact with each other until sufficient external pressure applied to the external surfaces of either the upper or lower member overcomes the flexible resiliency of either the upper or lower members permitting electrical contact to occur between the electrically conductive bands of the upper and lower members to generate electrical contact in those areas not occupied by the dielectric dot matrix array. The conductive bands are of substantially equal width, with the dots of the dielectric dot matrix array being of slightly narrower diameter than the width of the electrically conductive bands comprising the upper surface of the lower member.

The specific construction, consistency, dimensions and linear placement of the dielectric dot matrix, in combination with other specifically formulated elements of the overall pressure sensing switch array, provide consistently high and measurably improved broad surface area pressure sensitivity and selectivity. The use of strain relief stabilized releasable electrical snap stud connectors aids considerably in the ease of standardized production resulting in significantly lower final product cost, while concurrently improving the end-users product understanding and ease of use. The laminar members of the described invention are of heat stabilized polyester film with the conductive bands being formed of a specific formulation of silver/graphite conductive ink screened or otherwise appropriately printed on to their respective supportive members. In making this pressure sensing array, a complement of substantially parallel, spaced apart electrically conductive bands are applied to the upper surface of the lower flat, flexible member. To the upper surface of these aforementioned electrically conductive bands are fixed a dot matrix of a suitable dielectric material of highly specific thickness, diameter, and linear spaced pattern. A second complement of substantially parallel spaced apart electrically conductive bands are applied to the lower surface of the upper fiat flexible member. This array includes a conductive input lead connected between alternating members of this array and a strain relief stabilized releasable electrical snap stud connector. A second output electrical conductive lead is equivalently connected between those alternating electrically conductive elements not connected to the input electrically conductive lead, and thereto to an equivalent second strain relief stabilized releasable electrical snap stud connector. The upper and lower laminar members of the invention are separated from each other by a middle flat flexible member containing one or more openings. The upper, middle and lower members are suitably laminated together with the conductive arrays traversing the openings of the middle member, and each other, but being separated and held apart by the dots of dielectric material deposited on the upper surface of the electrically conductive bands which in turn are affixed to the upper surface of the lower flat flexible member. In this manner, unless overcome by external pressure, the electrical conductive bands affixed to the lower surface of the upper member are prevented from making electrical contact with the electrically conductive bands affixed to the upper surface of the lower member.

The thickness and base material composition of each of the three constructional laminar members is specific to provide effective resistance to unwanted kinking, bending, or creasing actions while concurrently providing sufficient flexibility of the upper and lower members that when limited and minimal external pressure is applied to the surface of such members resistance to electrical contact between the electrically conductive bands of the upper member and equivalent lower member provided by the linearly spaced apart dielectric dots affixed to the electrically conductive bands of the lower member in association with the inventions internal cavities provided by the openings of the middle member, is overcome. By this manner, an electrical signal passed into selected alternating components of the upper electrically conductive array through the strain relief stabilized releasable electrical snap stud connector pass into elements of the electrically conductive array affixed to the lower member and subsequently back from alternative locations on those same lower conductive array elements to elements of the upper electrical conductive array which in turn are connected to the output strain relief stabilized releasable electrical snap stud connector. In such a manner, upon application of a suitable pressure threshold to the invention, an electrical current is permitted to flow between the input strain relief stabilized releasable electrical snap stud connector through the electrically conductive elements of the invention to the output strain relief stabilized releasable electrical snap stud connection. The thickness and specifically selected base material of the construction lamina members of the invention, in association with the specific dimension and linear placement of the dielectric dots axed to the electrically conductive bands of the lower member are selected so as to provide sufficient resiliency to external pressure applied to the upper or lower members that when such pressure is released reliable separation of the electrically conductive elements of the upper and lower members is achieved thereby terminating the flow of electrical current between the input and output strain relief stabilized electrical snap stud connectors. In this manner, and through the use of appropriate constructional materials and dimensions, an effective balance between sensitivity of the invention to electrical activation by the application of external pressure thresholds and selectivity of the invention in providing reliable deactivation of such electrical connection upon removal of external threshold pressures, is achieved.

It is therefore an object of this invention to provide a pressure sensing switch array which reliably closes at relatively low threshold pressures applied to the array over a broad surface area, such equivalent pressures typically being those of human soft tissue rather than a hard or bony body prominence.

It is also an object of this invention to provide a pressure sensing array which will reliably open on release of equivalently described broad surface area pressure applications.

It is a further object of this invention to provide a pressure sensing array which will not accidentally close its electrical contact points until extensive flex has been applied to the array.

A further object of this invention is to provide a pressure sensing array which will minimize the cost of manufacture and significantly improve the ease of operator utilization through the incorporation of releasable electrical snap connectors.

It is also an object of this invention to provide accidental release protection of the aforementioned electrical snap connectors through the provision of a strain relief slot aperture positioned between the snap connectors.

It is further an object of this invention to provide reliable broad surface area pressure application activation of this device through the incorporation of a dielectric dot matrix of appropriate and specific construction, consistency and placement.

It is also an object of this invention to maximize the inherent reliability of electrical contact point conductivity within the device by limiting the internal impedance of the device to a maximum of 50 ohms at a point in the device furthest from the releasable electrical snap connectors.

Another object of the invention is to provide a pressure sensing switch array that lends itself to greater ease in mass production with significantly reduced impact on predictability and consistency in switch operation.

Another object of this invention it to provide a pressure sensing switch array of specifically defined thinness and flexibility to concurrently provide high patient comfort and minimization of the possibility of crimping or kinking when in use, which could result in inadvertent contact between internal electrical switch components.

BRIEF DESCRIPTION OF THE DRAWINGS

Other objects and advantages of this invention will become apparent upon reading the following detailed description, and upon reference to the drawings in which.

While the invention will be described in connection with a preferred embodiment and method, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
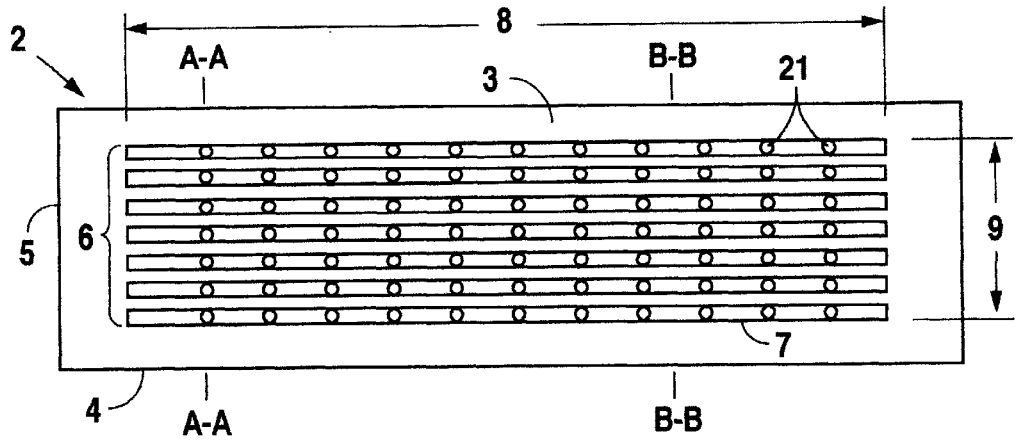
FIG. 1 is an upper plan view of a preferred embodiment of the lower member of the pressure sensing switch array with conductive elements applied thereon and also showing linearly spaced dielectric dots of appropriate dimensions applied to the upper surface of the aforementioned electrically conductive element array.
Figure 2:
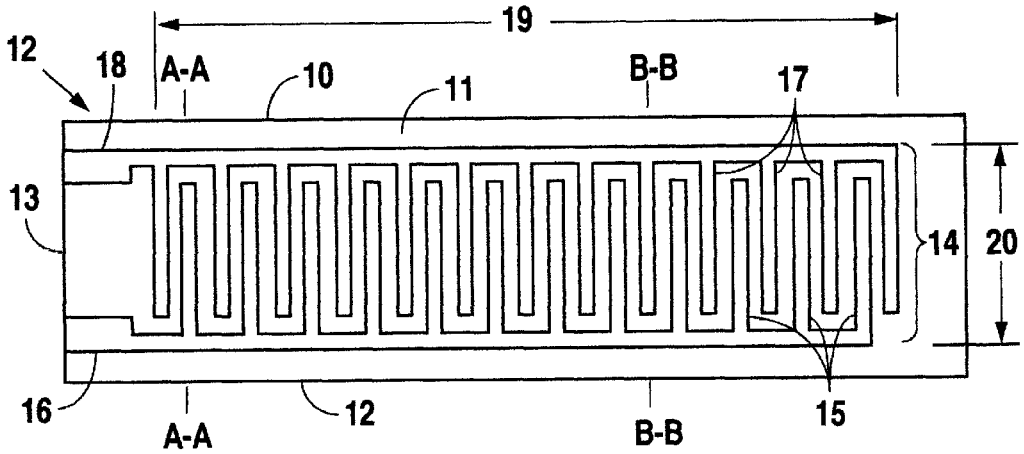
FIG. 2 is a lower plan view of a preferred embodiment of the upper member of the pressure sensing switch array showing input and output electrically conductive element arrays applied thereon.

Turning to FIG. 1, a preferred embodiment of the lower member of a pressure sensing switch array is illustrated. As shown, the lower member (2) consists of a flat, elongated, substantially rectangular sheet (3), having lengthwise edges (4), considerably longer than its width wise edges (5). An array (6) of electrically conductive bands (7) extends longitudinally on the upper face of the sheet. Preferably, the conductive bands (7) are parallel, of equal width, and aligned on equally spaced centers. The array (6) extends substantially across the interior portion of the upper face of sheet (3), the length (8) and width (9) of the array (6) leaving a relatively wide perimeter portion of the upper surface of sheet (3) without any electrically conductive element array. Preferably, the array (6) of conductive bands (7) will be applied by screen printing a conductive ink composition or equivalent on the upper surface of the lower member (2). As shown in FIG. 2, a preferred embodiment of the upper member (10) of the pressure sensing switch array also consists of a flat, elongated substantially rectangular sheet (11), preferably of length (12) and width (13) substantially equal to the length (4) and width (5) of the lower member (2). An array (14) of electrically conductive bands is applied to the bottom surface of the upper member (10), the width of the bands of the array (14) preferably being of equal width with each other and to the conductive bands (7) of the lower member (2). As shown, the upper member array (14) is preferably arranged in a width wise grid orthogonal to the lower member conductive array (6) on center lines preferably equally displaced as the center lines of the conductive bands (7) of the lower member (2). Preferably, alternate elements (15) of the upper member conductive array (14) are discretely connected to an electrically conductive input lead (16) while the other bands (17) of the upper member electrically conductive array (14) are discreetly connected to an electrically conductive output lead (18). Also preferably, the length (19) and width (20) of the array (14) is substantially the same as the length (8) and width (9) of the lower member conductive element array (7).

Referring again to FIG. 1, a preferred embodiment of linearly spaced dielectric dots (21) are applied over the bands of the electrically conductive array (7) which in turn are affixed to the top surface of the lower sheet (3). These linearly space dielectric dots are positioned with equally spaced centers on each individual band of electrically conductive array (7) so as to form vertical lines of dots, one each being affixed to each individual band of electrically conductive array (7) when a plan view of electrically conductive array (7) is viewed from the lengthwise edge of supportive sheet (3). Equivalently, these lines of linearly spaced dielectric dots are spaced from each other on each band of electrically conductive array (7) in a specifically and experimentally conducted manner prodding center to center positioning between the dielectric dots (21) of 9 mm along each band of electrically conductive array (7). Each individual dielectric dot (21) has a diameter of 2mm thereby making each dielectric dot (21) fractionally narrower than the width of each individual band of electrically conductive array (7).

Figure 3:
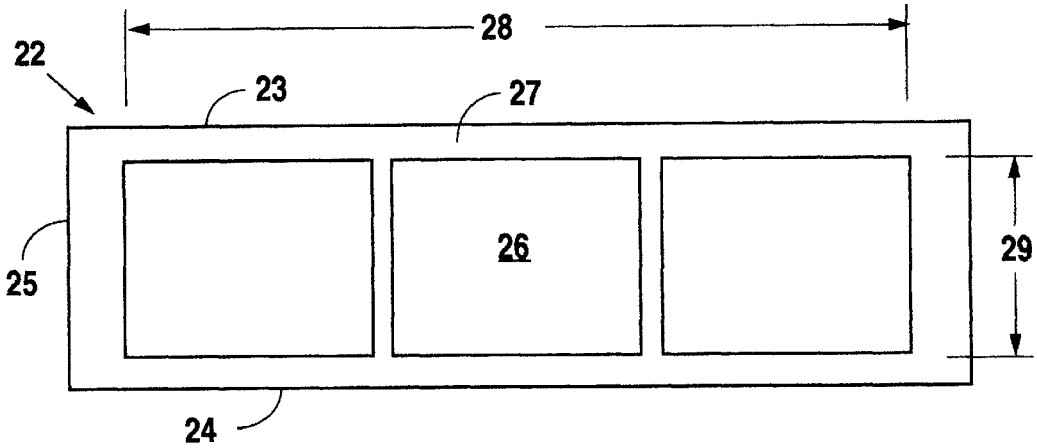
FIG. 3 is a reversible plan view of a preferred embodiment of the middle member of the pressure sensing switch array.

Turning now to FIG. 3, a preferred embodiment of a middle member of the pressure sensing switch array is illustrated. As shown, the middle member (22) consists of a flat, elongated, substantially rectangular sheet (23), preferably of length (24) and width (25) identical to the lengths (4) and (12) and width (5) and (13) of the lower and upper sheets (3) and (11). One or more openings (26) are provided through the middle member (27). The openings (26) are substantially rectangular and arranged in longitudinal alignment across the middle member (22). The total length (28) of the openings (77) is substantially equal to the lengths of the electrically conductive arrays (8) and (19) of the electrically conductive array arrangements (6) and number (14) of the lower and upper member conductive bands (7), (15) and (17). Similarly, the width (29) of the openings (26) is substantially equal to the widths (9) and (20) of the arrays (6) and (14) of the lower and the upper member conductor bands (7), (15) and (17).

Figure 4:
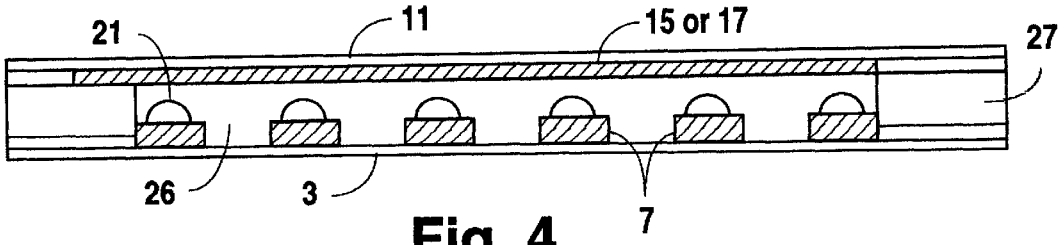
FIG. 4 is a sectional view taken along line A–A' of FIGS. 1 and 2 when superimposed on each other.
Figure 5:
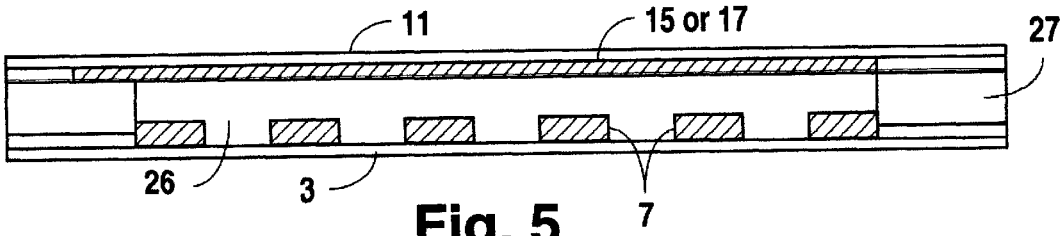
FIG. 5 is a sectional view taken along line B–B' of FIGS. 1 and 2 when superimposed upon each other.

Turning to FIGS. 4 and 5, the relative alignments of the upper member conductive bands (7) are shown. Linearly spaced dielectric dots (21) and the input and output electrically conductive bands(15) and (17) when the upper, middle and lower laminar members (2), (22) and (10) are laminarly arranged is shown. In FIG. 4 the segment of this arrangement shows the conductive bands (7) affixed to the lower member sheet (3) and supporting on the upper surface of conductive bands (7) linearly arranged and aligned dielectric dots (21). Affixed to the lower surface of upper member sheet(11) are input and output conductive electric arrays (15) and (17). These alternating arrays (15) and (17) traverse the lower member (3) electrically conductive array (6) and its linearly spaced, attached dielectric dots (21). Input and output electrically conductive arrays (15) and (17) of top member (10) are also separated from lower member (3) electrically conductive array (6) by middle member (27) cavities (26). FIG. 5 shows an equivalent sectional section of the completed laminar assembly at a point fractionally further along the overall assembly where the linearly spaced dielectric dots (21) are absent from the surface of the electrically conductive array (6). However, even at this cross-sectional point of the overall laminar assembly, input and output electrically conductive arrays (15) and (17) are still separated from electrically conductive array (6) affixed to lower member (3) by the internal cavity formed by opening (26) of the middle member (27). By virtue of the arrangement of the linearly space dielectric dots a defined number of upper member (11) electrically conductive input and output array elements (15) and (17) come into full electrical contact following the application of external threshold pressure with lower member (3) electrical array elements (7). The specific positioning of the linearly arranged dielectric dots (21), in association with the internal dimension of the internal cavity (26) provide effective balance and control necessary to insure that appropriate minimum applications of threshold pressure to the cavity portions of the overall pressure sensing switch array will consistently cause effective completion of the switching circuit and also that removal or lack of such threshold pressure will reliably cause the circuit not to be completed. In making the pressure sensing switch array, the conductive elements are screen printed onto their respective members. Preferably the upper and lower members (3) and (11) will be 5 mils heat stabilized polyester and the conductive bands (7), (15) and (17) are printed of a suitable conductive ink formulation to provide a maximum internal impedance level within the completed pressure sensing switch array of approximately 45 ohms when one square inch of pressure is applied at the most distal end of the electrically conductive arrays with respect to the input and output releasable electrical snap connectors (30) and (31). The input and output leads (16) and (18) of the upper member conductive bands (15) and (17) are screen printed simultaneously with the conductive bands (15) and (17). After the conductive ink has been printed onto the lower sheet (3) the linearly spaced dielectric dot matrix (21) is affixed by direct application or equivalent screen printing techniques to lower member conductive array (7). A variety of manufacturing techniques may be employed to produce either sheet arrays or multiple sheet arrays for final assembly operations of the completed pressure sensing switch array device. The middle member (22) will preferably be formed of a seven mil thick polyester sheet coated with an appropriate layer of bonding adhesive to accomplish lamination. The upper, middle and lower laminar members (2), (22) and (12) are then laminated together using either heat or adhesive lamination processes as appropriate, bonding the middle member (22) between the lower and upper members (2) and (12).

Figure 7:
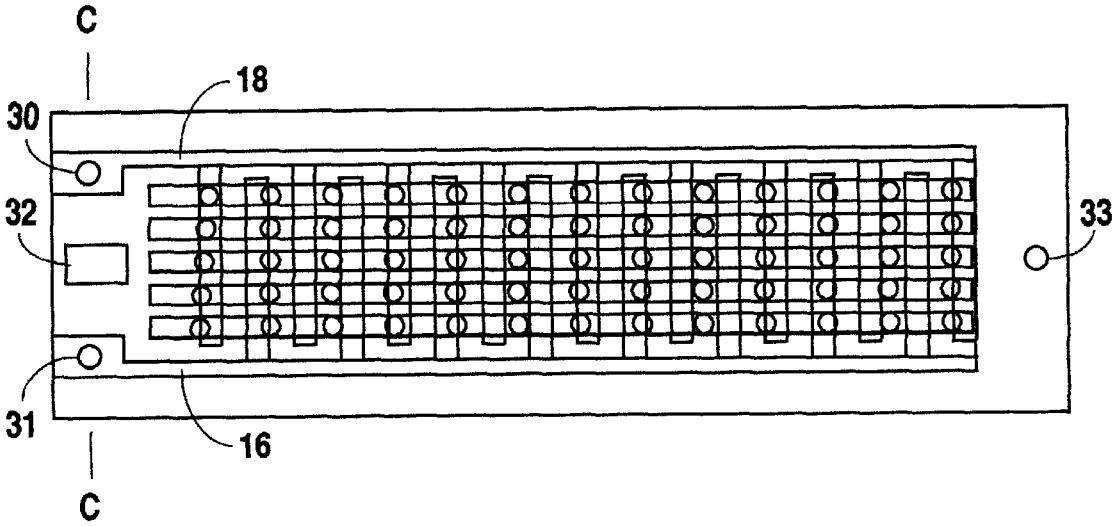
FIG. 7 is an upper plan view of a preferred embodiment of the pressure sensing switch array.

FIG. 7 illustrates the upper member (12) of FIG. 2 superimposed upon the top of the lower member (2) of FIG. 1. The polyester material used in laminar members (2), (22) and (12) may be clear or opaque. Also shown in FIG. 7 are electrical input and output leads (16) and (18) respectively, extending to strain relief stabilized releasable electrical snap stud connector studs (30) and (31). Positioned equally distantly between releasable electrical snap connector studs (30) and (31) is strain relief aperture (32) which passes through all three structural laminar elements (2), (22) and (12). At the distal end of the completed laminar structure is attachment aperture (33) also passing through all three structural laminar elements (2), (22) and (12) and of sufficient diameter to permit the passage of a rubber band or similar elastic attachment device.

Figure 6:
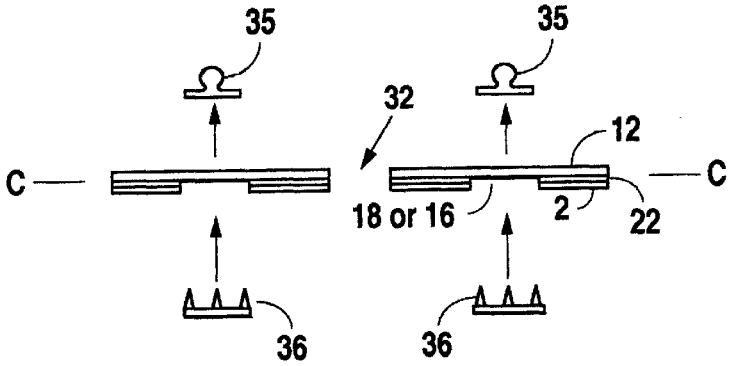
FIG. 6 is a sectional view showing the attachment method of the releasable electrical snap connectors taken along line C–C' on FIG. 7.
Figure 6A:
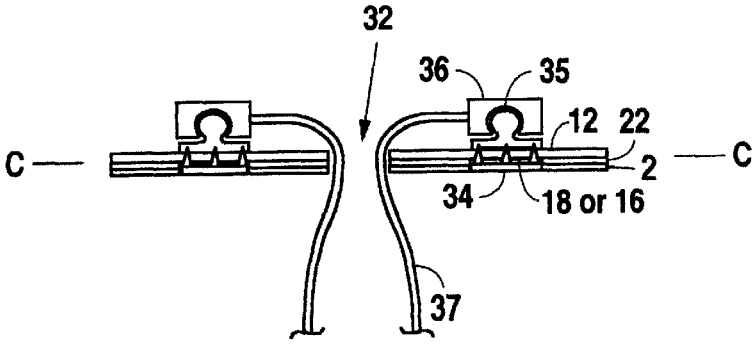
FIG. 6A is a sectional view per FIG. 6 above illustrating the utilization of EKG type snap connectors in conjunction with the strain relief stabilization slot aperture.
Figure 6B:
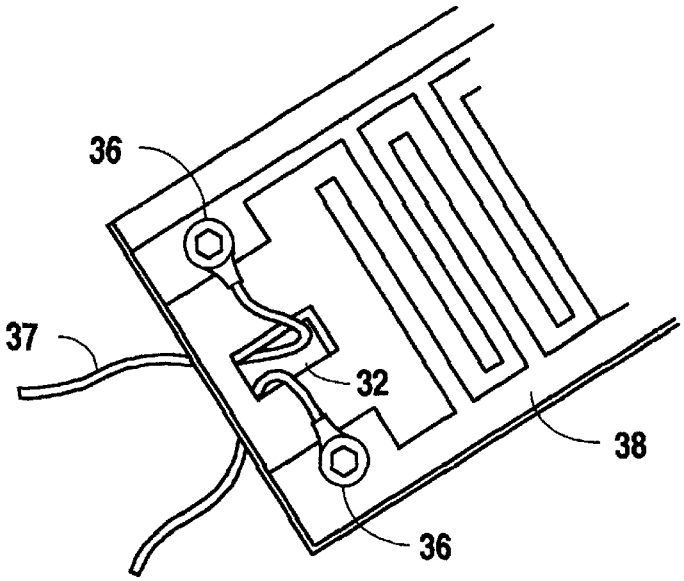
FIG. 6B is an oblique upper plan view of FIG. 6 showing the utilization of the strain relief slot aperture in association with EKG type releasable snap connectors and their connecting cords.

Turning now to FIG. 6, a sectional arrangement along lines C–C' of FIG. 7 in the segment of this arrangement shown, the attachment technique of strain relief stabilized releasable electrical snap stud connector studs (30) and (31) to input and output connectors (16) and (18) deposited on and supported by upper member (12) is shown. In this arrangement a strain relief aperture window (36) is precut through lower laminar member (2) and middle laminar member (22) at the appropriate location with respect to input and output lead positions (16) and (18) prior to final lamination of laminar members (2), (22) and (12). In this manner the window aperture exposes the conductive surface of input lead (16) or output lead (18) as deposited on and supported by upper laminar member (12) after final lamination of laminar members (2), (22) and (12) has occurred. Toothed attachment ring (34) is then driven through conductive lead (16) or (18) and subsequently through the polyester base fabric of upper laminar member (12). The toothed connecting ring is then securely crimped to releasable electrical stud connector (35), tightly sandwiching electrical input or output conductive lead (16) or (18) and upper laminar member (12). In this manner a secure electrical connection is effected between strain relief stabilized releasable electrical snap stud connector (35) and the electrically conductive material of input or output lead (16) or (18). As shown in FIGS. 6A and 6B, EKG style electrical snap connectors (36) in association with their electrical connecting cords (37) are then passed through strain relief aperture (32) from the lower side [toothed ring attachment side] of the final laminated pressure sensing array assembly and attached respectively to the releasable electrical stud connectors (30) and (31) respectively, attached to input and output electrical leads (16) and (18). In this manner an effective strain relief between the EKG snap connectors (36) and the releasable electrical stud connectors is generated, as an external pull if now exerted on the flexible electrical leads (37) connected to the EKG snap connectors (36) will now pull that EKG snap connector (36) down towards the upper surface of the completed laminar assembly (38) rather than up and away from it. The device as shown is an elongated, rectangular configuration with conductive arrays (6) and (14) in an orthogonal arrangement and a linearly spaced dielectric dot array (21) intersecting this orthogonal conductive arrays arrangements (6) and (14) in a specified linear spaced pattern. While this arrangement is preferred, it is not necessary that the conductive arrays (6) and (14) be in an orthogonal relationship to each other or that they can be on an equally spaced center pattern. Depending on the particular application involved, it is necessary only that a limited matrix of effective electrical contact points be established so as to provide the consistency of operation and control desired for any given external threshold pressure. In the preferred embodiment described, an external threshold pressure of approximately 1 to 1½ pounds per square inch will reliably electrically activate the invention making the invention highly suitable for use between relatively soft external compressive forces such as that found between fleshy areas on a human body and a surface of a medical mattress. It has been found that for effective operation in such a described environment that a switch device approximately 3.5" wide× 32" long with 5 mil heat stabilized polyester upper and lower members (2) and (12) and a 7 mil polyester middle member (22) with 3 openings (26) each 23 centimeters long by 5 centimeters wide and spaced 1 centimeter apart and inset from each end of the device by 3.75 centimeters and inset from the side of the device by 2.5 centimeters creates an effective and workable structure. In this arrangement, upper and lower member conductive element bands (7), (15) and (17) of 2.5 millimeters width on 5 millimeters centers with 2 millimeter diameter dielectric dots affixed in a parallel linear pattern on conductive elements (7) of the lower laminar member (2) on 9 millimeter centers provide an optimum arrangement.

Thus, it is apparent that it has been provided, in accordance with the invention, a pressure sensing switch array and method of making such a switch that fully satisfies the objects, aims and advantages set forth above.

While the invention has been described in conjunction with specific embodiments and methods, it is evident that many alternatives modifications and alternatives will be a apparent to those skilled in the art in light of the above foregoing description. Accordingly, it is intended to embrace all such alternatives, modifications and variations as followed in the spirit of the appended claims.

I claim:

1. A pressure sensing switch array comprising:

upper, middle, and lower laminar elongated nonconductive members, said middle member having a plurality of openings there through defining a plurality of cavities between said upper and lower members;

an array of substantially parallel electrically conductive bands fixed to an upper surface of said lower member and positioned to traverse the middle member cavities;

an array of substantially parallel electrically conductive bands fixed to a lower surface of said upper member and positioned to traverse the middle member cavities, a first set of said upper member bands collectively connected to an electrical input connector and a second set of said upper member bands being collectively connected to an electrical output connector;

an array of regularly spaced dielectric dots fixed to the upper surface of the lower member bands and partially separating the bands of the upper and lower members from electrical contact with each other through the middle member cavities at specific spaced positions;

said upper and lower laminar members being resiliently flexible to permit overlapping areas between said upper and lower member arrays of conductive bands to close into and open out of electrical contact through said middle member cavities upon exertion and removal respectively of a minimal threshold external compressive force against said members.

2. The pressure sensing switch array according to claim 1, wherein said upper member conductive band array is generally orthogonal to said lower member conductive band array.

3. The pressure sensing switch array according to claim 2, wherein said conductive bands of said upper member array are arranged with center lines substantially equally spaced.

4. The pressure sensing switch array according to claim 2, wherein said conductive bands of said lower member array are arranged with center lines substantially equally spaced.

5. The pressure sensing switch array according to claim 3, wherein said conductive bands of said lower member array are arranged with center lines substantially equally spaced, whereby said overlapping areas occur in an orthogonal matrix of squares and said regularly spaced dielectric dots occur in a partially offset orthogonal matrix defining a plurality of linear sets of said dielectric dots.

6. The pressure sensing switch array according to claim 1, wherein said upper and lower member conductive bands are formed of a low impedance conductive ink.

7. The pressure sensing switch array according to claim 6, wherein a maximum internal electrical impedance is 50 ohms on application of 1 pound per square inch of pressure at a distal end of said switch.

8. The pressure sensing switch array according to claim 7, wherein said input and output electrical connectors terminate in strain relief stabilized releasable electrical snap stud connectors.

9. The pressure sensing switch array according to claim 1, wherein said upper, middle, and lower laminar elongated nonconductive members are comprised of heat stabilized polyester material.

10. A pressure sensing switch array comprising:

upper, middle and lower laminar substantially rectangular elongated members, said middle member having a plurality of longitudinally aligned substantially rectangular openings there through defining a plurality of cavities between said upper and lower members;

an array of substantially parallel and equally spaced electrically conductive bands fixed in longitudinal alignment to an upper surface of said lower member and positioned to traverse said cavities;

an array of substantially parallel and equally spaced electrically conductive bands fixed transversely across a lower surface of said upper member in a direction orthogonal to said lower member bands, selected upper member bands being collectively connected to an electrical input lead and other upper member bands being collectively connected to an electrical output lead;

an array of linearly arranged and equally spaced dielectric dots fixed to an upper surface of said lower member bands and being arranged to provide a plurality of essentially parallel rows of dielectric dots on said lower member and said dielectric dots providing controlled separation of said electrically conductive arrays on said upper and lower members; said upper and lower members being resiliently flexible to permit said controlled separation of said arrays of conductive bands by said dielectric dot array to close into and open out of electrical contact upon exertion and removal respectively of a threshold external compressive force.

11. A pressure sensing switch array comprising:

upper, middle and lower laminar non-conductive elongated members, said middle member having at least one opening there through defining at least one cavity between the upper and lower members;

an array of spaced electrically conductive bands fixed to an upper surface of said lower member and traversing said at least one cavity;

an array of spaced electrically conductive bands fixed to a lower surface of said upper member and traversing said at least one cavity and said lower member bands, selected upper member bands being connected to an electrical input lead and other upper member bands being connected to an electrical output lead;

an array of linearly arranged dielectric dots fixed to said upper surface of said lower member and arranged to form parallel rows of dielectric dots providing controlled separation of said upper and lower electrically conductive arrays through said at least one cavity;

said upper and lower members being resiliently flexible to permit said upper and lower member electrically conductive arrays to close into and open out of electrical contact upon exertion and removal respectively of an appropriate threshold external compressive force.

12. A pressure sensing switch array comprising:

a first and a second laminar member having spaced apart opposed interior laminar faces defining a plurality of substantially rectangular longitudinally aligned cavities;

at least one electrically conductive band fixed longitudinally to said interior face of said first member and traversing said cavities;

an array of substantially parallel and equally spaced electrically conductive bands fixed transversely across said at least one band of said first member, to said interior face of said second member and traversing said cavities, selected second member bands being connected through a strain relief stabilized releasable electrical snap stud connector into a first electrically conductive network and other second member bands being connected by a second strain relief stabilized releasable electrical snap stud connector into a second electrically conductive network;

said first and second electrically conductive networks being electrically isolated from each other, said upper and lower members being controllably separated by a matrix of dielectric dots, said upper and lower members being resiliently flexible to permit selected points of said conductive bands to close into and open out of electrical contact upon exertion and removal, respectively, of an appropriate threshold external compressive force.

* * * * *